US009247601B2

(12) United States Patent
Hsiu et al.

(10) Patent No.: US 9,247,601 B2
(45) Date of Patent: Jan. 26, 2016

(54) LIGHT EMITTING DEVICE CONTROL CIRCUIT WITH DIMMING FUNCTION AND CONTROL METHOD THEREOF

(71) Applicants: Leng-Nien Hsiu, Zhubei (TW); Pei-Yuan Chen, Zhubei (TW); Chien-Yang Chen, Taipei (TW)

(72) Inventors: Leng-Nien Hsiu, Zhubei (TW); Pei-Yuan Chen, Zhubei (TW); Chien-Yang Chen, Taipei (TW)

(73) Assignee: RICHTEK TECHNOLOGY CORPORATION, Zhubei, Hsinchu (TW)

( * ) Notice: Subject to any disclaimer, the term of this patent is extended or adjusted under 35 U.S.C. 154(b) by 0 days.

(21) Appl. No.: 14/559,927

(22) Filed: Dec. 4, 2014

(65) Prior Publication Data

US 2015/0173153 A1 Jun. 18, 2015

Related U.S. Application Data

(60) Provisional application No. 61/916,748, filed on Dec. 16, 2013.

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01)

(58) Field of Classification Search
CPC ..... H05B 37/02; H05B 33/0815
USPC ..... 315/201, 224, 291
See application file for complete search history.

(56) References Cited

U.S. PATENT DOCUMENTS

| | | | | |
|---|---|---|---|---|
| 2008/0074058 | A1* | 3/2008 | Lee et al. | 315/291 |
| 2011/0309759 | A1* | 12/2011 | Shteynberg et al. | 315/201 |
| 2012/0176826 | A1* | 7/2012 | Lazar | 363/126 |
| 2015/0077009 | A1* | 3/2015 | Kunimatsu | 315/224 |

* cited by examiner

*Primary Examiner* — Don Le
(74) *Attorney, Agent, or Firm* — Tung & Associates

(57) ABSTRACT

The present invention discloses a light emitting device control circuit with dimming function and a control method thereof. The light emitting device control circuit includes: a dimmer circuit, a rectifier and filter circuit, a power converter circuit, and a headroom voltage regulation circuit. The dimmer circuit generates an AC dimming voltage according to an AC voltage. The rectifier and filter circuit generates an input voltage according to the AC dimming voltage. The power converter circuit operates according to a control signal to convert the input voltage to an output voltage which is supplied to a light emitting device circuit. The headroom voltage regulation circuit generates the control signal according to a reference value and a difference between the input voltage and the output voltage, and regulates the difference at a level corresponding to the reference value by a feedback control loop.

11 Claims, 6 Drawing Sheets

LIGHT EMITTING DEVICE CONTROL CIRCUIT WITH DIMMING FUNCTION AND CONTROL METHOD THEREOF

CROSS REFERENCE

The present application claims priority to U.S. 61/916,748, filed on Dec. 16, 2013.

BACKGROUND OF THE INVENTION

1. Field of Invention

The present invention relates to a light emitting device control circuit with dimming function and a control method thereof; particularly, it relates to such a light emitting device control circuit which has a headroom regulation function to avoid a flicker of the light emitting devices, and a control method thereof.

2. Description of Related Art

FIG. 1A shows a conventional light emitting device control circuit 10. As shown in FIG. 1A, the light emitting device control circuit 10 receives an AC voltage (AC) and converts it to a DC output voltage Vout which is supplied to a light emitting device circuit 1. The light emitting device circuit 1 for example includes plural light emitting diodes (LEDs). The light emitting device control circuit 10 includes a TRIAC (TRI-electrode AC switch) dimmer circuit 11, a rectifier and filter circuit 13, and a power converter circuit 19, wherein the power converter circuit 19 includes a power stage control circuit 191 and a power stage circuit 192. The TRIAC dimmer circuit 11 receives the AC voltage (AC) (as indicated by a small sinusoidal signal waveform in the figure). When the AC voltage (AC) reaches a predetermined trigger phase, the TRIAC dimmer circuit 11 fires (starts-up), i.e., it is turned ON to generate an AC dimming voltage Vdim (as indicated by a small phase-cut sinusoidal signal waveform in the figure). The rectifier and filter circuit 13 rectifies and filters the AC dimming voltage Vdim to generate an input voltage Vin (as indicated by a small DC signal waveform with ripples in the figure). FIGS. 1B and 1C show schematic waveforms of the AC voltage and AC dimming voltages Vdim1 and Vdim2 with different trigger phases, wherein the AC voltage is indicated by a dash line and the AC dimming voltages Vdim1 and Vdim2 are indicated by solid lines. The rectifier and filter circuit 13 receives the AC dimming voltage Vdim, and rectifies them to generate an input voltages Vin which is inputted to the power converter circuit 19. The power converter circuit 19 is coupled to the rectifier and filter circuit 13, for converting the input voltage Vin to an output voltage Vout according to a control signal ACTL1, and the output voltage Vout is provided to the light emitting device circuit 1. In the aforementioned circuit, the TRIAC dimmer circuit 12 is provided for determining the trigger phase of the AC dimming voltage to adjust an average brightness of the light emitting device circuit 1. The power converter circuit 19 includes a power stage circuit 192 which has at least one power switch. The power stage circuit 192 may be a synchronous or asynchronous buck, boost, or inverting power stage circuit as shown in FIGS. 2A-2F.

To further explain, as an example, let us assume that the power converter circuit 19 includes a buck power stage circuit. FIG. 1B shows that the AC dimming voltage Vdim1 has an earlier trigger phase, and FIG. 1C shows the AC dimming voltage Vdim2 has a later trigger phase. The rectifier and filter circuit 13 rectifies and filters the AC dimming voltages Vdim1 and Vdim2, and correspondingly generates a DC input voltage Vin1 with a higher level and a DC input voltage Vin2 with a lower level Vin2. The control signal ACTL1 is direct proportional to the input voltage Vin (the control signal ACTL1 is a divided voltage of the input voltage Vin), so it indicates the brightness of the light emitting device circuit 1 that a user intends to set. The power stage control circuit 191 controls the power stage circuit 192 according to the control signal ACTL1, such that the conduction time of the power switch in the power stage circuit 192 is controlled according to the level of the input voltage Vin, and the current flowing through the light emitting device circuit 1 is adjusted accordingly, that is, the brightness of the light emitting device circuit 1 is adjusted according to the control signal ACTL1 which is direct proportional to the input voltage Vin.

The aforementioned prior art has the following drawback. Ideally, the output voltage Vout follows the control signal ACTL1 which is direct proportional to the input voltage Vin, so when the input voltage Vin increases, the output voltage Vout also increases, and when the input voltage Vin decreases, the output voltage Vout also decreases. However, in a real case, a power mismatch happens because of various conditions, such as unstable AC voltage frequencies, inconsistent phase-cut angles, etc., and therefore as shown in FIG. 1D, sometimes the input voltage Vin2 may be lower than the output voltage Vout. In this case, the buck power stage circuit can not operate, and a perceivable flicker occurs in the light emitting device circuit 1.

To overcome the drawback of the prior art, the present invention provides a light emitting device control circuit with dimming function and a control method thereof. The present invention provides a headroom regulation function to avoid a flicker of the light emitting device circuit.

SUMMARY OF THE INVENTION

In one perspective, the present invention provides a light emitting device control circuit with dimming function, including: a dimmer circuit for generating an AC dimming voltage according to an AC voltage; a rectifier and filter circuit, which is coupled to the dimmer circuit, for generating an input voltage according to the AC dimming voltage; a power converter circuit, which is coupled to the rectifier and filter circuit, for operating at least one power switch therein according to a control signal to convert the input voltage to an output voltage, wherein the output voltage is supplied to a light emitting device circuit; and a headroom voltage regulation circuit, which is coupled to the power converter circuit, for generating the control signal according to a reference value and a difference between the input voltage and the output voltage, and regulating the difference at a level corresponding to the reference value by a feedback control loop.

In one preferable embodiment, the headroom voltage regulation circuit includes: a difference sampling circuit, for generating a headroom voltage according to the difference; and a comparison circuit, which is coupled to the difference sampling circuit, for generating the control signal according to the headroom voltage and a reference voltage, wherein the reference voltage corresponds to the reference value.

In one preferable embodiment, the difference sampling circuit includes a voltage divider circuit, which has a voltage divider node for generating the headroom voltage.

In the aforementioned embodiment, the difference sampling circuit preferably further includes a capacitor, which is coupled to the voltage divider node of the divider circuit.

In one preferable embodiment, the headroom regulation circuit includes: an adder circuit or a subtractor circuit, for adding to or subtracting a reference voltage from a voltage corresponding and related to one of the input voltage and the output voltage, wherein the reference voltage corresponds to the reference value; and a comparison circuit, which is coupled to the adder circuit or the subtractor circuit, for generating the control signal according to a voltage corresponding and related to the other one of the input voltage and the output voltage and an operation result of the adder or the subtractor circuit.

In one preferable embodiment, the reference voltage is adjustable.

In one preferable embodiment, the light emitting device control circuit with dimming function further includes an electronic transformer, which is coupled to the dimmer circuit, for receiving the AC dimming voltage to generate a high frequency AC dimming voltage for being inputted to the rectifier and filter circuit.

In another perspective, the present invention provides a control method of a light emitting device control circuit with dimming function, including: receiving an input voltage, wherein the input voltage has an average value which is controllably changeable; operating at least one power switch in a power converter circuit according to a control signal to convert the input voltage to an output voltage for being supplied to a light emitting device circuit; and generating the control signal according to a reference value and a difference between the input voltage and the output voltage, and regulating the difference at a level corresponding to the reference value by a feedback control loop.

The objectives, technical details, features, and effects of the present invention will be better understood with regard to the detailed description of the embodiments below, with reference to the attached drawings.

DESCRIPTION OF THE PREFERRED EMBODIMENTS

Figure 1A:
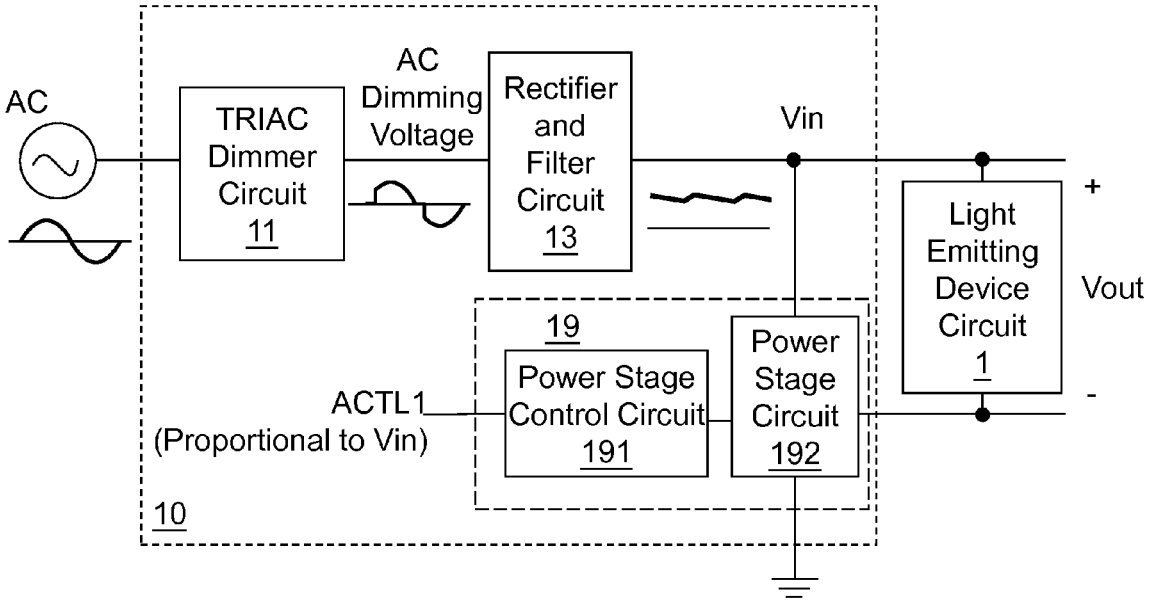
Fig. 1A (Prior Art)
FIG. 1A shows a schematic circuit diagram of a conventional light emitting device control circuit 10.
Figure 1B:
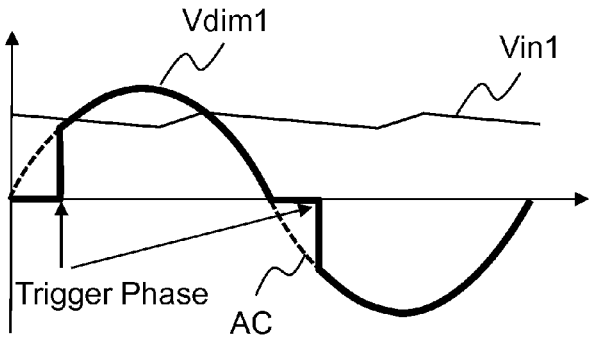
Fig. 1B (Prior Art)
FIGS. 1B and 1C show signal waveforms of an AC voltage, different AC dimming voltages, and corresponding input voltages.
Figure 1C:
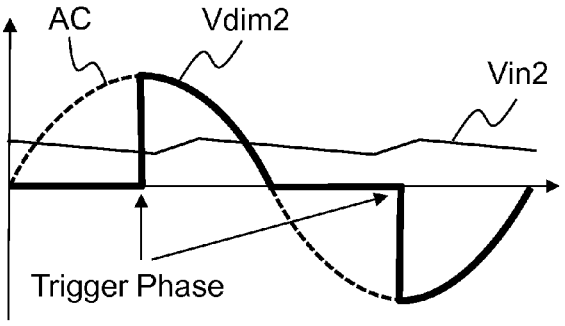
Fig. 1C (Prior Art)
Figure 1D:
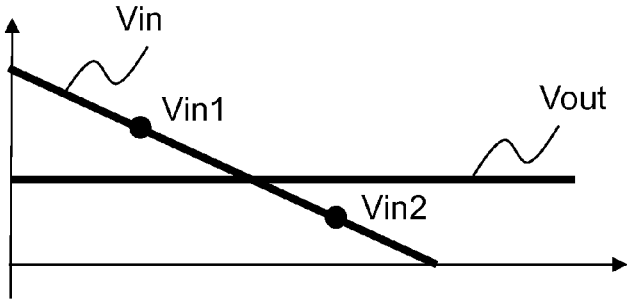
Fig. 1D (Prior Art)
FIG. 1D shows a schematic diagram of a condition wherein the input voltage Vin is lower than the output voltage Vout because of power mismatch.
Figure 2A:
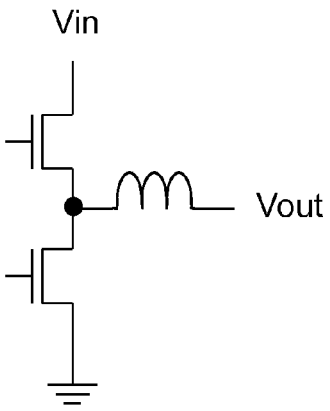
FIGS. 2A-2F show synchronous and asynchronous buck, boost, and inverting power stage circuits.
Figure 2B:
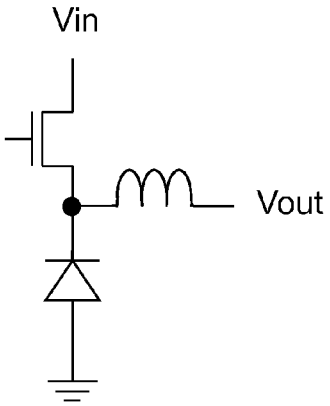
Figure 2C:
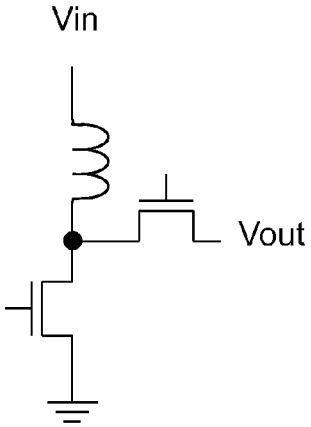
Figure 2D:
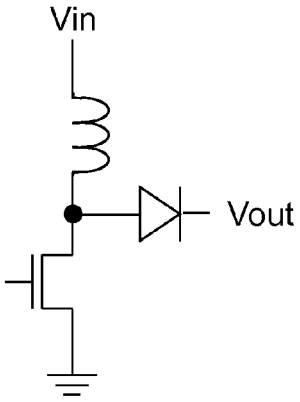
Figure 2E:
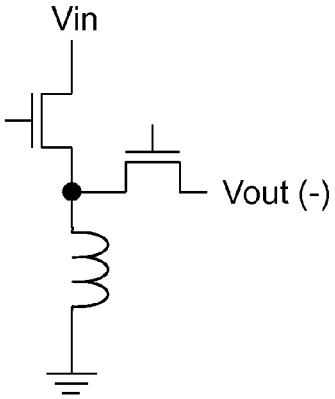
Figure 2F:
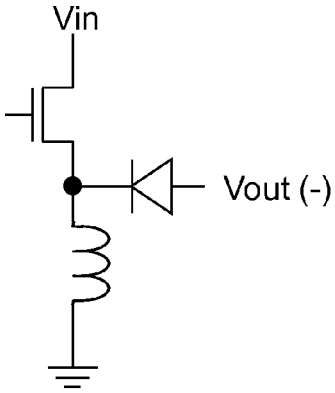
Figure 3A:
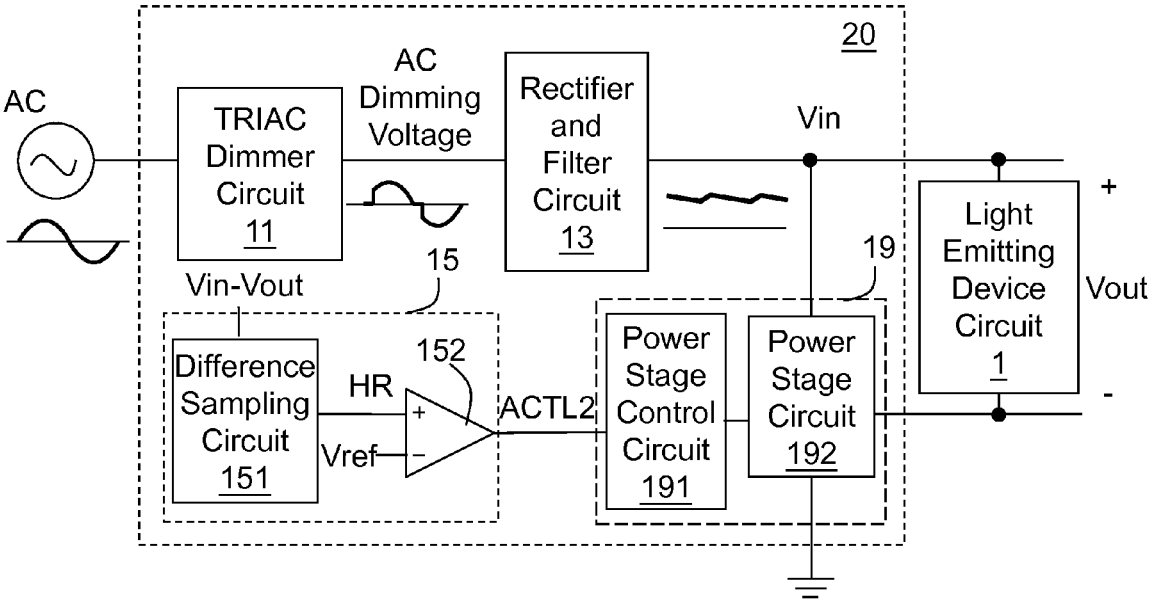
FIGS. 3A-3B show a first and a second embodiment of the present invention.

Please refer to FIG. 3A, which shows a first embodiment of the present invention. As shown in FIG. 3A, a light emitting device control circuit 20 includes a tri-electrode AC switch (TRIAC) dimmer circuit 11, a rectifier and filter circuit 13, a headroom voltage regulation circuit 13, and a power converter circuit 19, wherein the power converter circuit 19 includes a power stage control circuit 191 and a power stage circuit 192. The TRIAC dimmer circuit 11 generates the AC dimming voltage (indicated by the solid line waveform as shown in FIG. 1B, such as the AC dimming voltage Vdim1) according to the AC voltage (indicated by the dashed line waveform as shown in FIG. 1B). The rectifier and filter circuit 13 is coupled to the TRIAC dimming circuit 11, for generating the input voltage Vin (for example indicated by the thin solid line waveform of the input voltage Vin as shown in FIG. 1A) according to the AC dimming voltage. The rectifier and filter circuit 13 is for example a bridge rectifier circuit, optionally further including a low-pass filter circuit or a power factor correction (PFC) circuit. The rectifier and filter circuit 13 can be embodied in various forms, as well known by those skilled in the art, so details thereof are omitted here. The power converter circuit 19 is coupled to the rectifier and filter circuit 13 for receiving the input voltage Vin, and operating at least one power switch therein (not shown, referred to switches shown in FIGS. 2A-2F) to convert the input voltage Vin to an output voltage Vout according to a control signal ACTL2, wherein the output voltage Vout is supplied to the light emitting device circuit 1. The light emitting device circuit 1 can be, for example but not limited to, a single light emitting diode (LED), a single LED string including plural LEDs connected in series, or an LED array including plural LED strings connected in parallel, etc. The power converter circuit 19 may be a synchronous or asynchronous buck, boost, or inverting power stage circuit as shown in FIGS. 2A-2F.

The present invention is different from the prior art in that, in the present invention, the light emitting control circuit 20 further includes a headroom voltage regulation circuit 15 which generates the control signal ACTL2 according to a difference between the input voltage Vin and the output voltage Vout, and a reference value. The headroom voltage regulation circuit 15 regulates the difference between the input voltage Vin and the output voltage Vout at a level corresponding to the reference value by a feedback control loop. In this embodiment, the headroom voltage regulation circuit 15 includes a difference sampling circuit 151 and a comparison circuit 152. The difference sampling circuit 151 generates a headroom voltage HR according to the input voltage Vin and the output voltage Vout, wherein the headroom voltage HR corresponds and relates to the difference between the input voltage Vin and the output voltage Vout. The headroom voltage HR for example is the difference itself, a ratio of the difference, or a filtered value of the difference or the ratio. (Therefore, in this specification, a subject voltage itself, a ratio such as a divided voltage of the subject voltage, or a filtered value of the subject voltage or the ratio are regarded and referred to as "a voltage corresponding and related to the subject voltage"). The comparison voltage 152 is coupled to the difference sampling circuit 151, for generating the control signal ACTL2 by comparing the headroom voltage HR with a reference voltage Vref (the reference voltage Vref corresponds to the aforementioned reference value). Thus, by operation of the feedback control loop, the headroom voltage HR is regulated at a predetermined voltage, which is the reference voltage Vref in this embodiment. Because the headroom voltage HR is regulated at the reference voltage Vref, the difference between the input voltage Vin and the output voltage Vout is maintained at a constant value, as shown in FIG. 3C; the constant value corresponds to the reference voltage Vref.

Figure 3B:
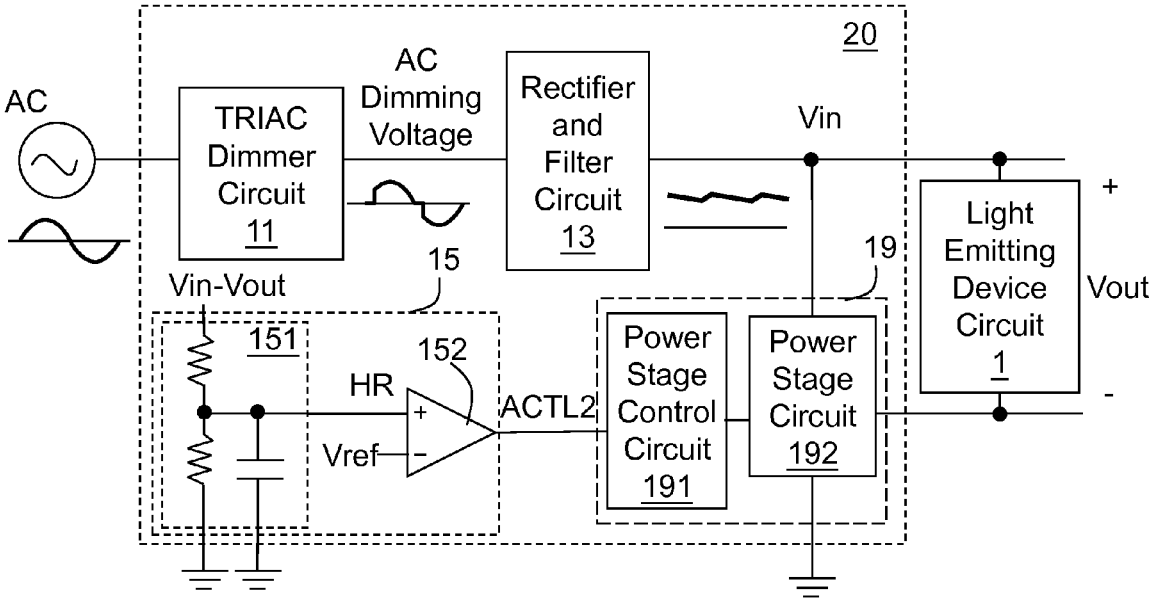
Figure 3C:
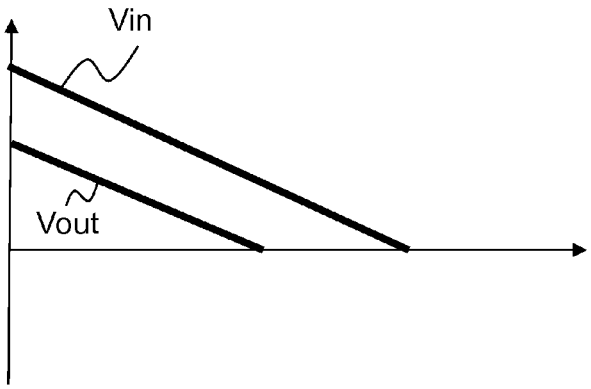
FIG. 3C shows that the voltage difference between the input voltage Vin and the output voltage Vout can be maintained consistently.

Please refer to FIG. 3B. In one embodiment, the difference sampling circuit 151 for example includes a voltage divider circuit and an RC circuit, which obtains a DC average value of a divided voltage of the difference between the input voltage Vin and the output voltage Vout at a divider node therein, and the DC average value is provided as the headroom voltage HR by which. The difference sampling circuit 151 is not limited to this embodiment as shown in the figure, but may be embodied in various forms, such as a divider circuit without a capacitor, a sample-and-hold circuit, or a circuit further including another filter circuit, etc.

Note that in this embodiment, the difference between the input voltage Vin and the output voltage Vout is obtained by subtracting the output voltage Vout from the input voltage Vin, i.e., Vin-Vout. This is because, in this embodiment, as an example, the power converter circuit 19 includes a buck power stage circuit. However, if the power converter circuit 19 includes a boost power stage circuit, the difference between the input voltage Vin and the output voltage Vout should be obtained by subtracting the input voltage Vin from the output voltage Vout.

Figure 4:
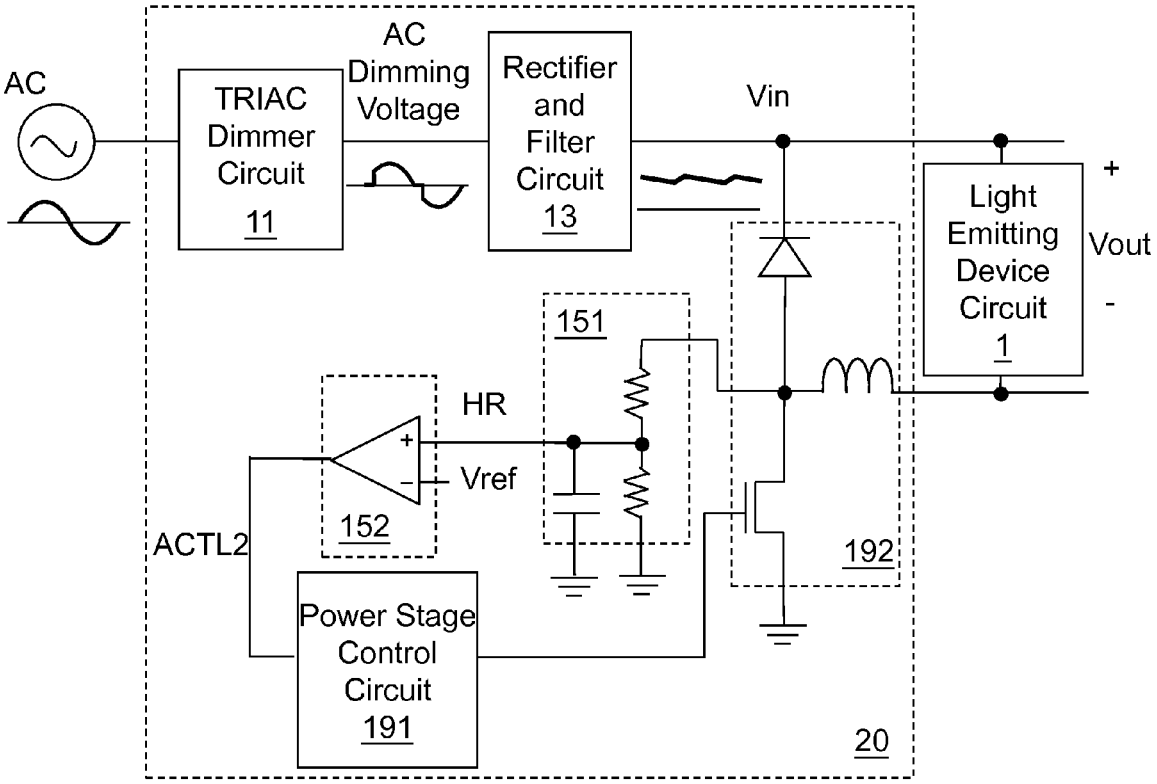
FIG. 4 shows a third embodiment of the present invention.

FIG. 4 shows a second embodiment of the present invention, which is a more specific embodiment of the light emitting device control circuit 20. FIG. 4 shows an example wherein the power converter circuit 19 includes a buck power stage circuit, and in this embodiment, the difference sampling circuit 151 can be connected as shown to obtain the difference between the input voltage Vin and the output voltage Vout from a node between a power switch and an inductor in the power stage circuit 192. When the overall circuitry operates, the input voltage Vin can be maintained higher than the output voltage Vout.

Figure 5A:
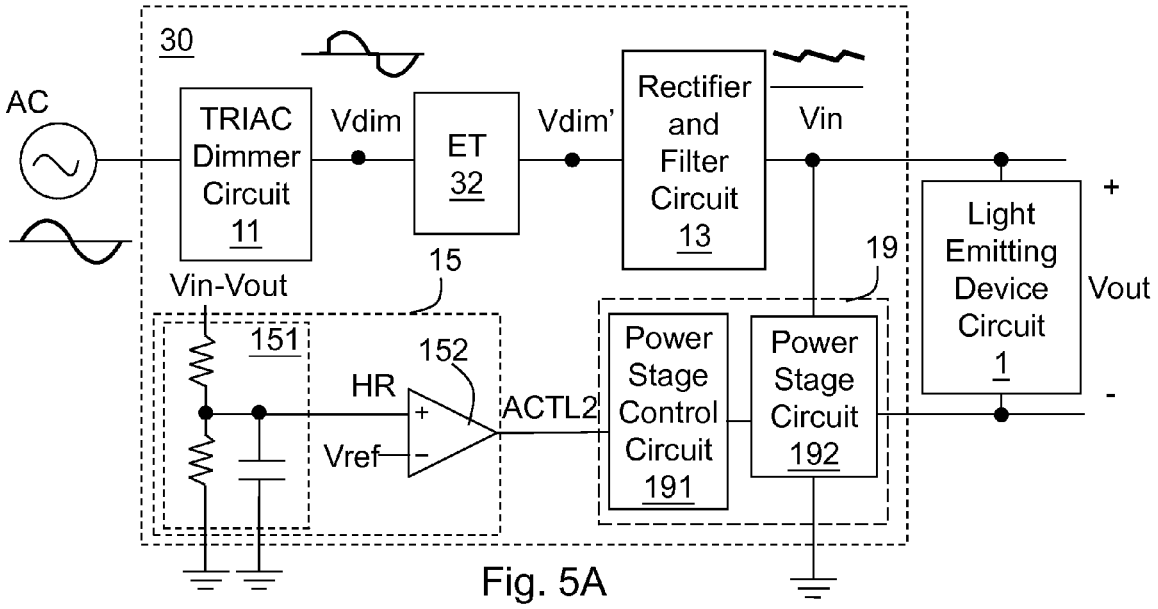
FIGS. 5A-5B show a fourth embodiment of the present invention.
Figure 5B:
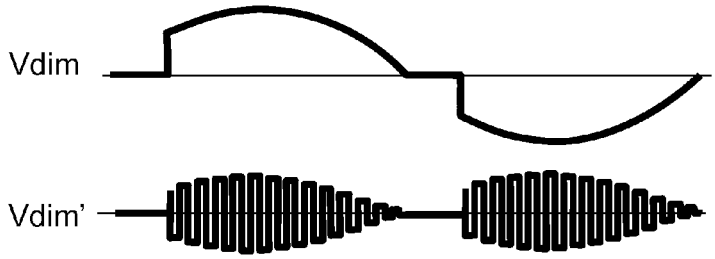

FIGS. 5A-5B show a third embodiment of the present invention. This embodiment shows a light emitting device control circuit 30. Different from the first embodiment, this embodiment further includes an electronic transformer (ET) 32, which is coupled to the TRIAC dimmer circuit 11, for receiving the AC dimming voltage Vdim to generate a high frequency AC dimming voltage Vdim' which is inputted to the rectifier and filter circuit 13. Schematic signal waveforms of the AC dimming voltage Vdim and the high frequency AC dimming voltage Vdim' are shown in FIG. 4B. This embodiment indicates that the light emitting device control circuit can further include an ET according to the present invention.

Figure 6A:
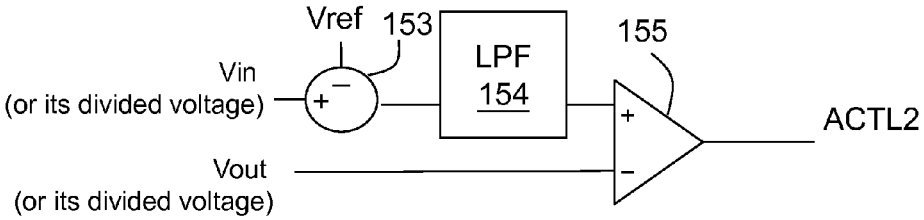
FIGS. 6A-6B show two other embodiments of the headroom regulation circuit of the present invention.
Figure 6B:
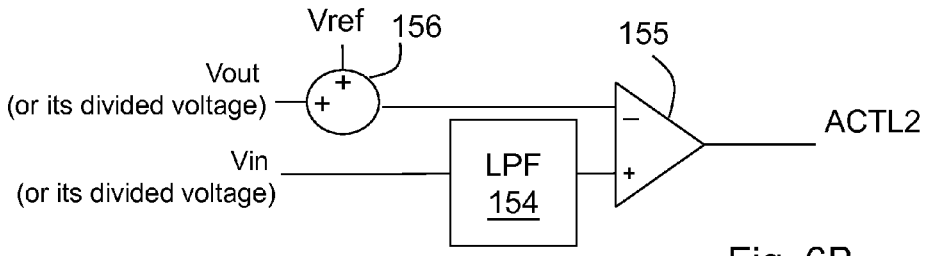

The aforementioned embodiments compare the "voltage corresponding and related to the difference between the input voltage Vin and the output voltage Vout" with the reference voltage Vref. This arrangement can be modified in various equivalent forms. For example, under the circumstance that the power converter circuit 19 includes a buck power stage circuit, referring to FIG. 6A, an equivalent form is to compare "a voltage corresponding and related to the input voltage Vin minus the reference voltage Vref" with "a voltage corresponding and related to the output voltage Vout". More specifically, in one embodiment, a subtractor circuit 153 subtracts the reference voltage Vref from the input voltage Vin or its divided voltage. The output of the subtractor circuit 153 is filtered by a low-pass filter (LPF) 154; a comparison circuit 155 (which can be a digital comparator or an analog error amplifier) compares the output of the LPF 154 with the output voltage Vout or its divided voltage. Equivalently, referring to FIG. 6B, the subtractor circuit 153 may be replaced by an adder circuit 156, and the reference voltage Vref is added to a voltage corresponding and related to the output voltage Vout (the output voltage Vout or its divided voltage in this embodiment) by the adder circuit 156. The comparison circuit 155 compares the output of the adder circuit 156 with a voltage corresponding and related to the input voltage Vin (the input voltage Vin or its divided voltage in this embodiment). The LPF 154 is optional and can be omitted. The comparison circuit 155 generates the control signal ACTL2 according to its comparison result.

If the power converter circuit 19 includes a boost power stage circuit, the input voltage Vin and the output voltage Vout should be interchanged in the last paragraph.

Figure 7A:
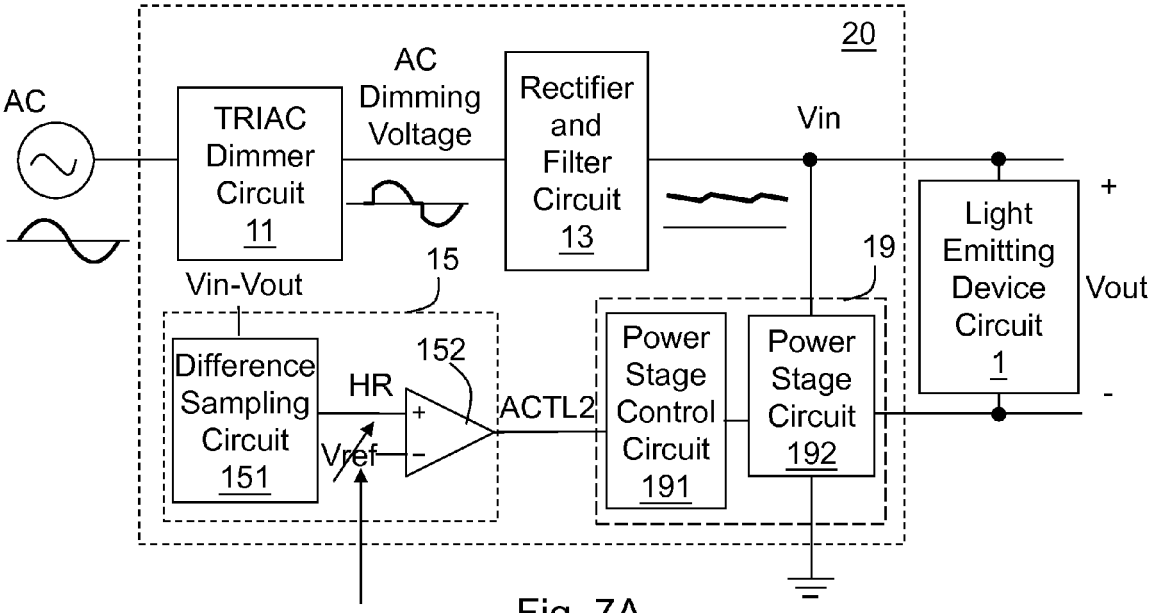
FIGS. 7A-7B show two embodiments wherein the reference voltage is adjustable.
Figure 7B:
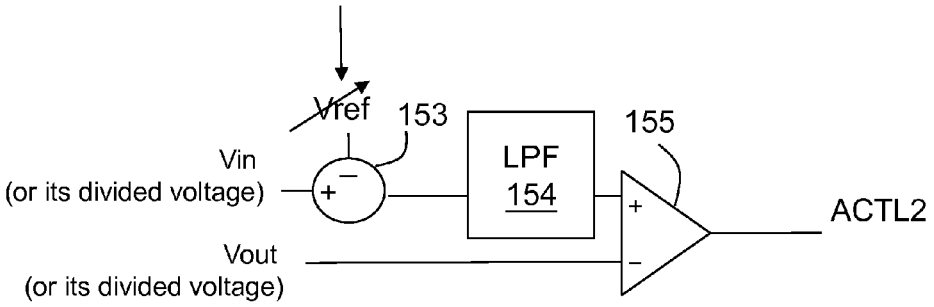

Furthermore, although the feedback control loop of the present invention can maintain the difference between the input voltage Vin and the output voltage Vout at a level corresponding to the reference voltage Vref, the reference voltage Vref is not necessarily a predetermined constant, but can be an adjustable value. For example, referring to FIGS. 7A-7B, the reference voltage Vref may be adjusted by a signal from internal or external of the circuitry.

The present invention has been described in considerable detail with reference to certain preferred embodiments thereof. It should be understood that the description is for illustrative purpose, not for limiting the scope of the present invention. An embodiment or a claim of the present invention does not need to achieve all the objectives or advantages of the present invention. The title and abstract are provided for assisting searches but not for limiting the scope of the present invention. Those skilled in this art can readily conceive variations and modifications within the spirit of the present invention. For example, a device which does not substantially influence the primary function of a signal can be inserted between any two devices shown to be in direction connection in the shown embodiments, such as a switch. For another example, the light emitting device that is applicable to the present invention is not limited to the LED as shown and described in the embodiments above, but may be any light emitting device with a forward terminal and a reverse terminal. For another example, power converter circuit is not limited to the buck or boost power converter circuit, but may be any type of power converter circuits as shown in FIGS. 2A-2F, with corresponding amendments. In view of the foregoing, the spirit of the present invention should cover all such and other modifications and variations, which should be interpreted to fall within the scope of the following claims and their equivalents.

What is claimed is:

1. A light emitting device control circuit with dimming function, comprising:

a dimmer circuit configured to operably generate an AC dimming voltage according to an AC voltage;

a rectifier and filter circuit, which is coupled to the dimmer circuit, and configured to operably generate an input voltage according to the AC dimming voltage;

a power converter circuit, which is coupled to the rectifier and filter circuit, and configured to operably operate at least one power switch therein according to a control signal to convert the input voltage to an output voltage, wherein the output voltage is supplied to a light emitting device circuit; and a headroom voltage regulation circuit, which is coupled to the power converter circuit, and configured to operably generate the control signal according to a reference value and a difference between the input voltage and the output voltage, and regulate the difference at a level corresponding to the reference value by a feedback control loop;

wherein the headroom voltage regulation circuit includes:

a difference sampling circuit, configured to operably generate a headroom voltage according to the difference; and a comparison circuit, which is coupled to the difference sampling circuit, and configured to operably generate the control signal according to the headroom voltage and a reference voltage, wherein the reference voltage corresponds to the reference value.

2. The light emitting device control circuit with dimming function of claim 1, wherein the difference sampling circuit includes a voltage divider circuit, which has a voltage divider node configured to operably generate the headroom voltage.

3. The light emitting device control circuit with dimming function of claim 2, wherein the difference sampling circuit further includes a capacitor, which is coupled to the voltage divider node of the divider circuit.

4. The light emitting device control circuit with dimming function of claim 2, wherein the reference voltage is adjustable.

5. A light emitting device control circuit with dimming function, comprising:

a dimmer circuit configured to operably generate an AC dimming voltage according to an AC voltage;

a rectifier and filter circuit, which is coupled to the dimmer circuit, and configured to operably generate an input voltage according to the AC dimming voltage;

a power converter circuit, which is coupled to the rectifier and filter circuit, and configured to operably operate at least one power switch therein according to a control signal to convert the input voltage to an output voltage, wherein the output voltage is supplied to a light emitting device circuit; and a headroom voltage regulation circuit, which is coupled to the power converter circuit, and configured to operably generate the control signal according to a reference value and a difference between the input voltage and the output voltage, and regulate the difference at a level corresponding to the reference value by a feedback control loop;

wherein the headroom voltage regulation circuit includes:

an adder circuit or a subtractor circuit, configured to operably add to or subtract a reference voltage from a voltage corresponding and related to one of the input voltage and the output voltage, wherein the reference voltage corresponds to the reference value; and a comparison circuit, which is coupled to the adder circuit or the subtractor circuit, and configured to operably generate the control signal according to a voltage corresponding and related to the other one of the input voltage and the output voltage and an operation result of the adder or the subtractor circuit.

6. The light emitting device control circuit with dimming function of claim 5, wherein the reference voltage is adjustable.

7. A light emitting device control circuit with dimming function, comprising:

a dimmer circuit configured to operably generate an AC dimming voltage according to an AC voltage;

a rectifier and filter circuit, which is coupled to the dimmer circuit, and configured to operably generate an input voltage according to the AC dimming voltage;

a power converter circuit, which is coupled to the rectifier and filter circuit, and configured to operably operate at least one power switch therein according to a control signal to convert the input voltage to an output voltage, wherein the output voltage is supplied to a light emitting device circuit; and a headroom voltage regulation circuit, which is coupled to the power converter circuit, and configured to operably generate the control signal according to a reference value and a difference between the input voltage and the output voltage, and regulate the difference at a level corresponding to the reference value by a feedback control loop;

an electronic transformer, which is coupled to the dimmer circuit, and configured to operably receive the AC dimming voltage to generate a high frequency AC dimming voltage for being inputted to the rectifier and filter circuit.

8. A control method of a light emitting device control circuit with dimming function, comprising:

receiving an input voltage, wherein the input voltage has an average value which is controllably changeable;

operating at least one power switch in a power converter circuit according to a control signal to convert the input voltage to an output voltage for being supplied to a light emitting device circuit; and generating the control signal according to a reference value and a difference between the input voltage and the output voltage, and regulating the difference at a level corresponding to the reference value by a feedback control loop;

wherein the step of regulating the difference at a level corresponding to the reference value includes:

generating a headroom voltage according to the difference; and generating the control signal according to the headroom voltage and a reference voltage, wherein the reference voltage corresponds to the reference value.

9. The control method of claim 8, wherein the reference voltage is adjustable.

10. A control method of a light emitting device control circuit with dimming function, comprising:

receiving an input voltage, wherein the input voltage has an average value which is controllably changeable;

operating at least one power switch in a power converter circuit according to a control signal to convert the input voltage to an output voltage for being supplied to a light emitting device circuit; and generating the control signal according to a reference value and a difference between the input voltage and the output voltage, and regulating the difference at a level corresponding to the reference value by a feedback control loop;

wherein the step of regulating the difference at a level corresponding to the reference value includes:

adding to or subtracting a reference voltage from a voltage corresponding and related to one of the input voltage and the output voltage, wherein the reference voltage corresponds to the reference value; and generating the control signal according to a voltage corresponding and related to the other one of the input voltage and the output voltage and an operation result of the addition or the subtraction.

11. The control method of claim 10, wherein the reference voltage is adjustable.

* * * * *